US005937683A

United States Patent [19]

Chartier

[11] Patent Number: 5,937,683

[45] Date of Patent: Aug. 17, 1999

[54] AUTOMOBILE REPAIR TOOL

[76] Inventor: Guy Chartier, 34 Scarcliff Gardens, West Hill, ONT M1E 2A2, Canada

[21] Appl. No.: 08/943,263

[22] Filed: Oct. 3, 1997

Related U.S. Application Data

[60] Provisional application No. 60/027,661, Oct. 7, 1996.

[51] Int. Cl.[6] ..... B21B 37/00

[52] U.S. Cl. ..... 72/21.5; 72/301; 72/705; 254/93 R

[58] Field of Search ..... 72/19.9, 20.1–20.4, 72/21.1, 21.4–21.6, 301, 302, 705, 436–438, 453.18, 392; 73/1.68, 744; 254/93 R; 173/206

[56] References Cited

U.S. PATENT DOCUMENTS

| | | | |
|---|---|---|---|
| 3,518,864 | 7/1970 | Pietronuto et al. | 72/302 |
| 3,891,187 | 6/1975 | Bearden, Jr. | 254/93 R |
| 3,893,650 | 7/1975 | Turben | 254/93 R |
| 3,894,586 | 7/1975 | Lyon | 173/91 |
| 3,992,919 | 11/1976 | Jarman | 254/93 R |
| 4,461,457 | 7/1984 | Steele | 254/93 R |
| 4,683,960 | 8/1987 | Kostylev et al. | 173/91 |
| 4,801,126 | 1/1989 | Rosman | 254/93 R |
| 4,867,252 | 9/1989 | Sudnishnikov et al. | 173/121 |
| 5,587,536 | 12/1996 | Rasmussen | 73/744 |

*Primary Examiner*—Joseph J. Hail, III
*Assistant Examiner*—Ed Tolan

[57] ABSTRACT

A tool for use in body and frame repair of vehicles in which a defined contracting force is repetitively applied. A pneumatic ram is used to apply a contracting force between two hooks. The force applied is defined by an operator and is monitored so that the pneumatic ram is cycled between an active state (applying the defined force) and a relaxed state. Since the operator is able to define the exact amount of force being applied, damage from excessive application of force is avoided.

18 Claims, 5 Drawing Sheets

AUTOMOBILE REPAIR TOOL

This is a continuation-in-part of U.S. Provisional Patent Application, Ser. No. 60/027,661, filed Oct. 7, 1996, and entitled "Automobile Repair Tool".

BACKGROUND

This invention relates generally to the automotive industry and more particularly to repairs of vehicles.

A major problem in the auto-body repair industry is referred to as "spring-back". This is a condition caused by stress in a damaged section of a vehicle which results in the metal springing back a considerable distance when the pulling device is released. To overcome this condition, the technician must stress relieve the structure.

Traditionally there have been three basic ways used to stress relieve metal.

(1) Heating by torch: This method is no longer allowed as it damages modern sheet metal alloys by altering the molecular structure;

(2) Hammer: By far, this is the best available method, but has definite limitations due to restricted space in most situations. Hammering can also cause secondary damage.

(3) Over-pulling: This is done with the hope that the metal springs back to the correct dimensions.

With over-pulling, there are usually two results:

(a) Pull is too light: In this case the damage springs back too far and the task requires additional pulls and wasted time;

(b) Pull is too heavy: When this occurs, the damage doesn't spring back far enough.

Further, when the pull is too heavy, a variety of ancillary problems develop. Even if the metal does not tear, the result may be that the metal may row have more damage than presented initially. To correct, the section must now be re-dimensioned, and/or crush-control sections must be restored. This is very time consuming and an expensive procedures (i.e. Metal shrinking, section replacement, etc.).

Because of this, most technicians will err on the side of a pull that's too light.

It is clear that there is a significant need for a tool which will assist in proper correction of automobile damage.

SUMMARY OF THE INVENTION

The invention is a tool for use in body and frame repair of vehicles in which a defined contracting force is repetitively applied. In a variety of applications, there is a need to "pull" or apply a contracting force to a body or frame of an automobile. The tool of this invention is adapted for this application.

A pneumatic ram is used to apply a contracting force between two hooks.

The present invention permits the contracting force being applied to be defined by an operator. Using a gauge, the operator sets the force which is desired. The actual force is then monitored so that the pneumatic ram applies only the force defined. Further, this force is cycled between an active state (applying the defined force) and a relaxed state.

Since the operator is able to define the exact amount of force being applied, damage from excessive application of force is avoided. Ideally, the manufacturer of the vehicle provides a reference having the recommended forces which should be applied. In some applications, the operator simply chooses a force which is less than required, applies that force and if the desired affect is not obtained, slightly increases the force.

The present invention contemplates several different embodiments.

The first embodiment is a pneumatic sledge hammer-like device that stress relieves the structure while the damaged section is being pulled back to specifications. In this embodiment, the apparatus is equipped with a chain hook at each end. One end is attached to the chain hooked up to the damaged area and the other end to the chain from the pulling device of this invention.

A compressed air line is attached to the air regulator on the control module. Compressed air flows through the air pressure line to the pressure inlet, and fills the air accumulator to provide a reservoir of compressed air.

When the tension, applied by the conventional pulling device, reaches the preset value, (i.e. 3 tons), the pneumatic swivel piston, extends, forcing the fluid in the pneumatic chamber to move the pressure reducing valve sufficiently to activate the preset automatic trigger. This opens a valve in the control module, allowing air pressure to open the control valve, thereby powering the piston which transmitting a heavy shock through the chain to the damaged metal. The heavy shock reduces the stress.

When the pulling tension decreases below the trigger value, (i.e. 3 tons), the control valve closes to seal the air in accumulator and the piston cylinder; the exhaust port is opened, allowing the air on the pressure side of the piston to exhaust to the atmosphere. Without the air within the piston, a compression spring is able to return the piston to the ready position.

The cycle repeats with the air accumulator recharging to prepare the invention for the next cycle.

Whenever the operator wants to establish manual control of the invention, a manual trigger, is pressed by the technician to override the automatic function.

The technician applies conventional pulling force to the damage, and the apparatus of this invention automatically relieves stress during the process. When the section being pulled reaches the proper dimensions, the technician presses the trigger to relax the tension on the pulling chains, thus achieving the desired results quickly, without overstretching or tearing or otherwise damaging the metal.

A variety of other embodiments for this invention are also contemplated. In one embodiment, the apparatus is configured as discussed above except that the piston member is permitted to oscillate in short strokes to obtain the desired result. This oscillation permits the automobile body to be "gently" pulled back into proper position.

The invention, together with various embodiments thereof will be more fully explained by the accompanying drawings and the following description.

DRAWINGS IN BRIEF

DRAWINGS IN DETAIL

Figure 1:
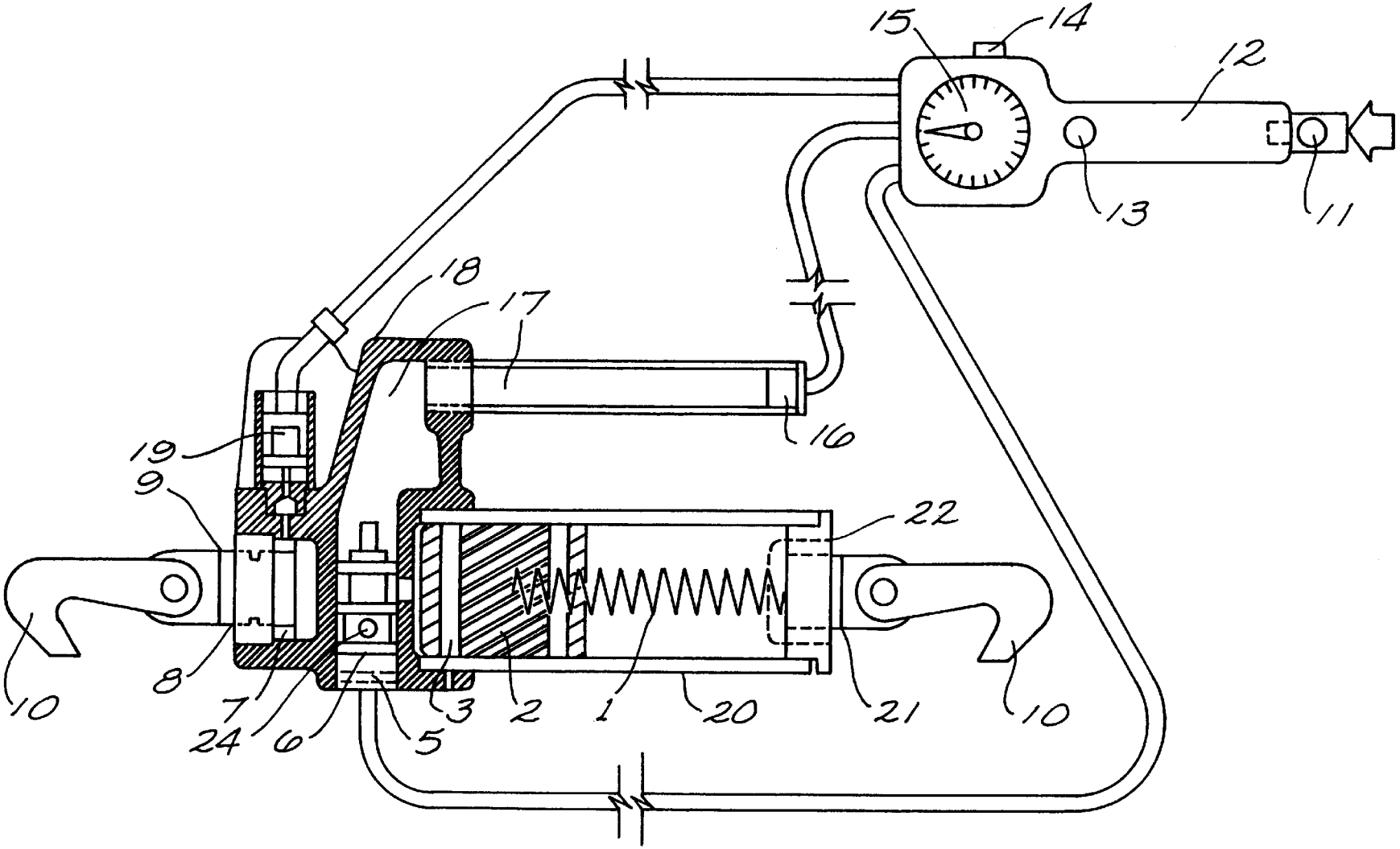
FIG. 1 is an operational view of the preferred embodiment of the invention.

FIG. 1 is an operational view of the preferred embodiment of the invention.

The preferred embodiment is a pneumatic sledge hammer-like device that stress relieves the structure while the damaged section is being pulled back to specifications. In this embodiment, the apparatus is equipped with a chain hook 10 at each end. One end is attached to the chain hooked up to the damaged area and the other end to the chain from the pulling device.

A compressed air line is attached to the air regulator 11 on the control module 12. Compressed air flows through the air pressure line to the pressure inlet 16, and fills the air accumulator 17.

When the tension, applied by the conventional pulling device, reaches the preset value, (i.e. 3 tons), as set by automatic trigger 14, the pneumatic swivel piston 9, extends, forcing the fluid in the pneumatic chamber 7 (as confined by pneumatic gland 8) to move the pressure reducing valve 19 sufficiently to activate the preset automatic trigger. This opens a valve in the control module 12, allowing air pressure to open the control valve 6, powering the piston 2, transmitting a heavy shock through the chain to the damaged metal, and reducing the stress.

When the pulling tension decreases below the trigger value, (i.e. 3 tons), control valve 5 closes, sealing the air accumulator 17 to piston cylinder 20 port, and opening the exhaust port 22 (confined by exhaust retaining gland 21), allowing, due to pressure from compression spring 3, air on the pressure side of piston 3 to exhaust, via exhaust port 24, to the atmosphere. Compression spring 2 returns piston 3 to the ready position. The air accumulator 17 recharges, and the apparatus is ready for the next cycle.

The manual trigger 13, is pressed by the technician whenever desired, to override the automatic function.

The pressure being applied is shown on pressure gauge 15.

The technician applies conventional pulling force to the damage, and the apparatus of this invention automatically relieves stress during the process. When the section being pulled reaches the proper dimensions, the technician may press the trigger as required to relax the tension on the pulling chains, thus achieving the desired results quickly, without over-stretching or tearing or otherwise damaging the metal.

Figure 2:
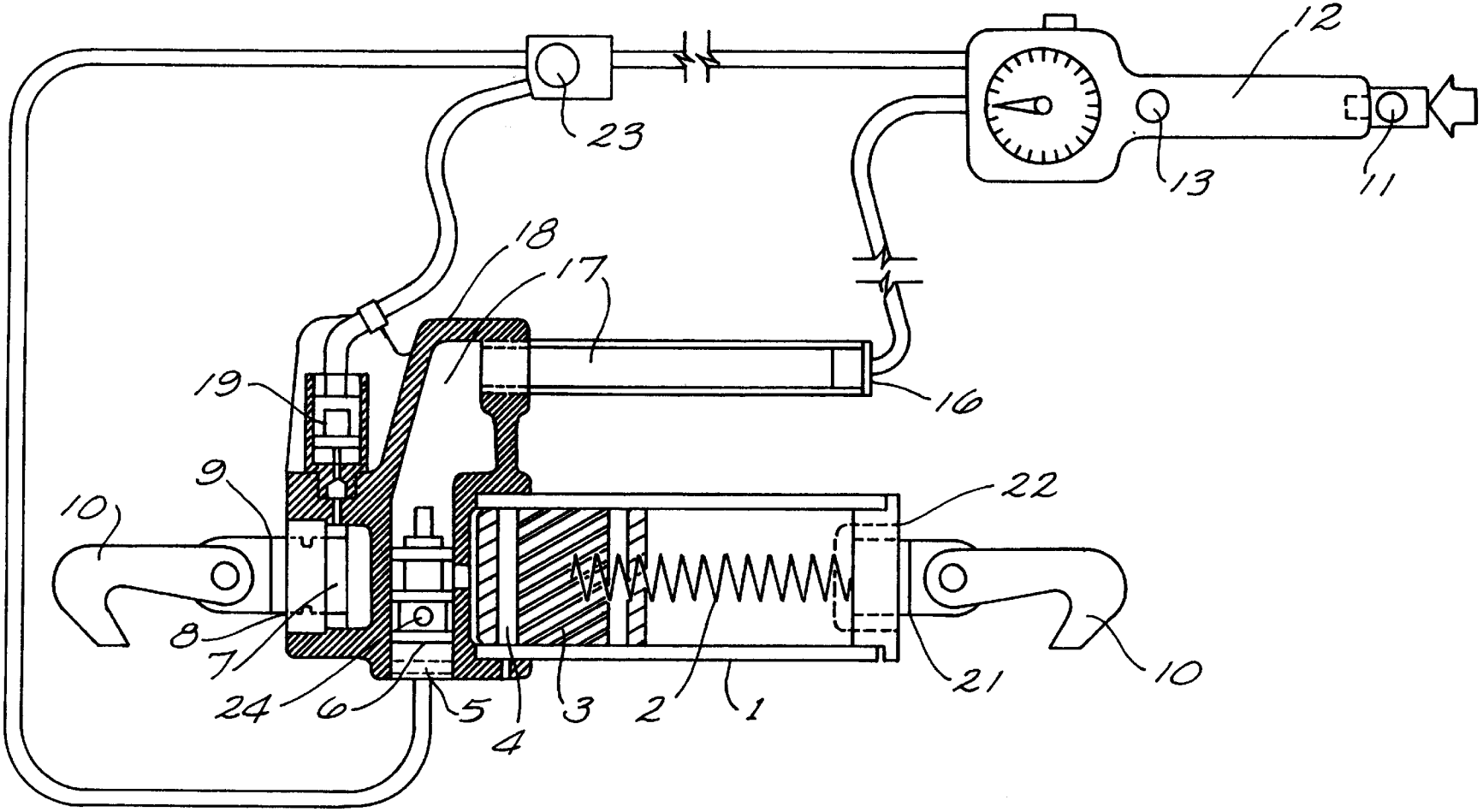
FIG. 2 is an operational view of an embodiment of the invention.

FIG. 2 is an operational view of an embodiment of the invention.

In this alternative embodiment, the apparatus is equipped with a chain hook 10 at each end. One end is attached to the chain hooked up to the damaged area and the other end to the chain from the pulling device. A compressed air line is attached to the air regulator 11 on the control module 12. Compressed air flows through the air pressure line to the pressure inlet 16, and fills the air accumulator 17.

When the tension, applied by the conventional pulling device, reaches the preset value, (i.e. 3 tons), the pneumatic swivel piston 9, extends, forcing the fluid in pneumatic chamber 7 to move the pressure reducing valve 19 sufficiently to activate the preset automatic trigger 23. This opens a valve between the pressure reducing valve 19 and control valve 6, powering the piston 3; thereby, transmitting a heavy shock through the chain to the damaged metal and reducing the stress.

When the pulling tension decreases below the trigger value, (i.e. 3 tons), control valve 6 closes, sealing the air accumulator 17 to piston cylinder 1 port, and opening the exhaust port 22 allowing the air on the pressure side of the piston to exhaust to the atmosphere. Compression spring 2 returns the piston to the ready position. The air accumulator 17 recharges, and the apparatus is ready for the next cycle.

The manual trigger 13, is pressed by the technician whenever desired, to override the automatic function.

In this manner, the technician applies conventional pulling force to the damage, and the invention automatically relieves stress during the process. When the section being pulled reaches the proper dimensions, the technician may press the trigger as required to relax the tension on the pulling chains, thus achieving the desired results quickly, without over-stretching or tearing or otherwise damaging the metal.

Figure 3:
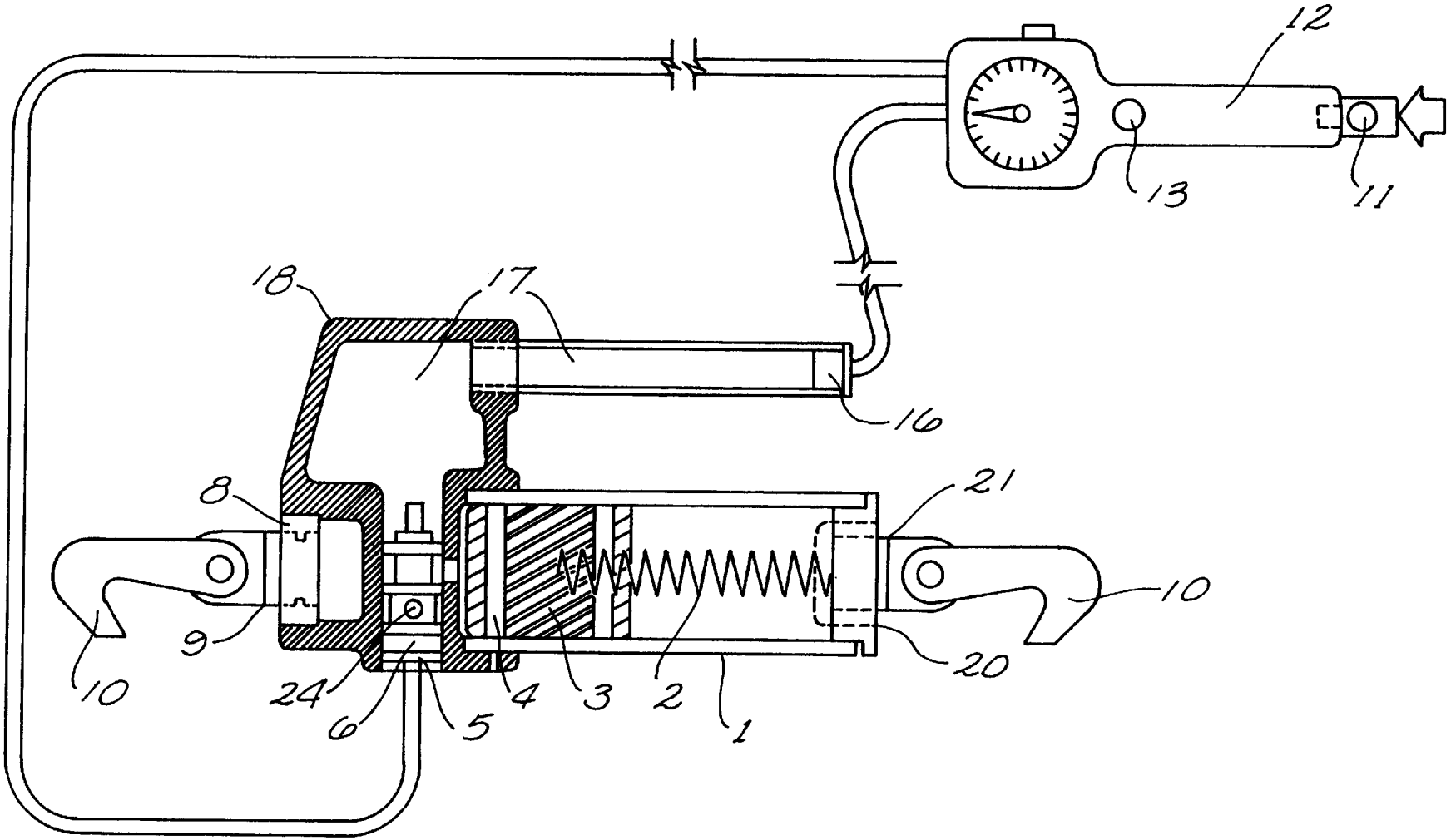
FIG. 3 is an operational view of still another embodiment of the invention.

FIG. 3 is an operational view of still another embodiment of the invention.

As before, this embodiment is equipped with a chain hook 10 at each end. One end is attached to the chain hooked up to the damaged area and the other end to the chain from the pulling device. A compressed air line is attached to the air regulator 11 on the control module 12. Compressed air flows through the air pressure line to the pressure inlet 16, and fills the air accumulator 17.

When the manual trigger 13, is pressed, a valve (not shown) in the control module 12 opens, allowing air pressure to open the control valve 6, powering the piston 3 and transmitting a heavy shock through the chain to the damaged metal.

When trigger 13 is released, control valve 6 reverses, exhaust port 22 opens, air on the pressure side of the piston 3 exhausts, the compression spring 2 returns piston 3 to the ready position, the air accumulator 17 recharges, and the apparatus is ready for the next cycle.

Conventional pulling force is applied to the damage, and whenever the technician wishes to relieve the stress, the technician actuates the apparatus by pressing manual trigger 13. When the section being pulled reaches the proper dimensions, the technician presses trigger 13 as required to relax the tension on the pulling chains, thus achieving the desired results quickly, without over-stretching or tearing or otherwise damaging the metal.

Figure 4:
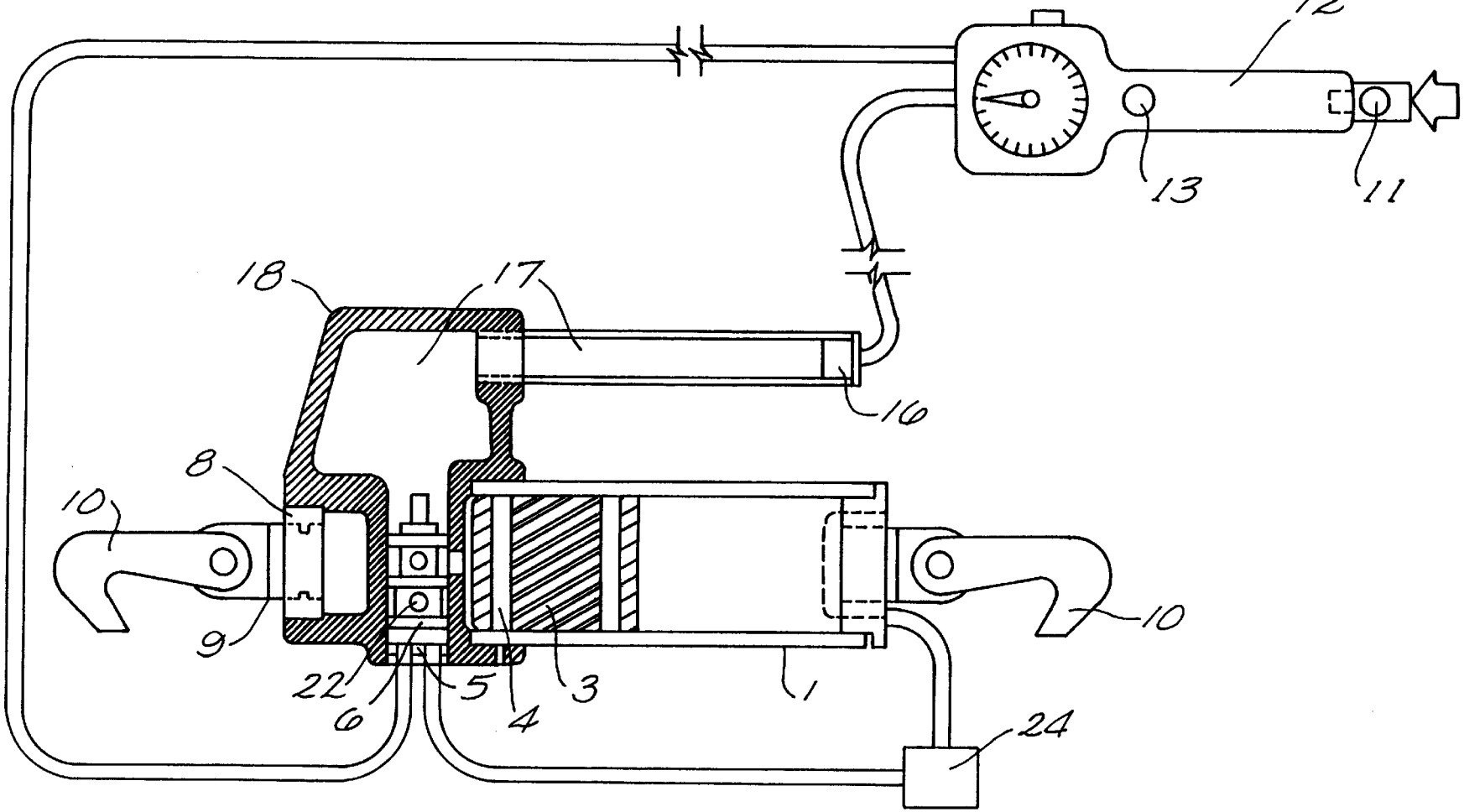
FIG. 4 is an operational view of yet another embodiment of the invention.

FIG. 4 is an operational view of yet another embodiment of the invention.

The apparatus is equipped with a chain hook 10 at each end. As before, one end is attached to the chain hooked up to the damaged area and the other end to the chain from the pulling device. A compressed air line is attached to the air regulator 11 on the control module 12. Compressed air flows through the air pressure line to the pressure inlet 16, and fills the air accumulator 17.

When the manual trigger 13, is pressed, a valve (not shown) in the control module 12 opens, allowing air pressure to open the control valve 6 and powering piston 3. Simultaneously, the exhaust pressure relief valve 24 opens the exhaust side of cylinder 1 to the atmosphere and closes to the pressure line. In this manner, a heavy shock through the chain to the damaged metal is created to reduce the stress.

When trigger 13 is released, valves 6 and 24 reverse, the air on the pressure side of the piston 3 exhausts, the exhaust side of the piston 3 pressurizes and piston 3 returns to the ready position, the air accumulator recharges, and this embodiment is ready for the next cycle.

In a still another alternative embodiment, the apparatus is configured as discussed above except that the piston member is permitted to oscillate in short strokes to obtain the desired result. This oscillation permits the automobile body to be "gently" pulled back into proper position.

In yet another embodiment of the invention, the apparatus is built into an existing pulling system to conserve space and to provide added versatility to existing equipment designs. This embodiment is therefore advantageous due to its: reduced expense for acquisition; reduced weight; reduced shipping costs; and to lowered pneumatic pressure requirements.

Figure 5:
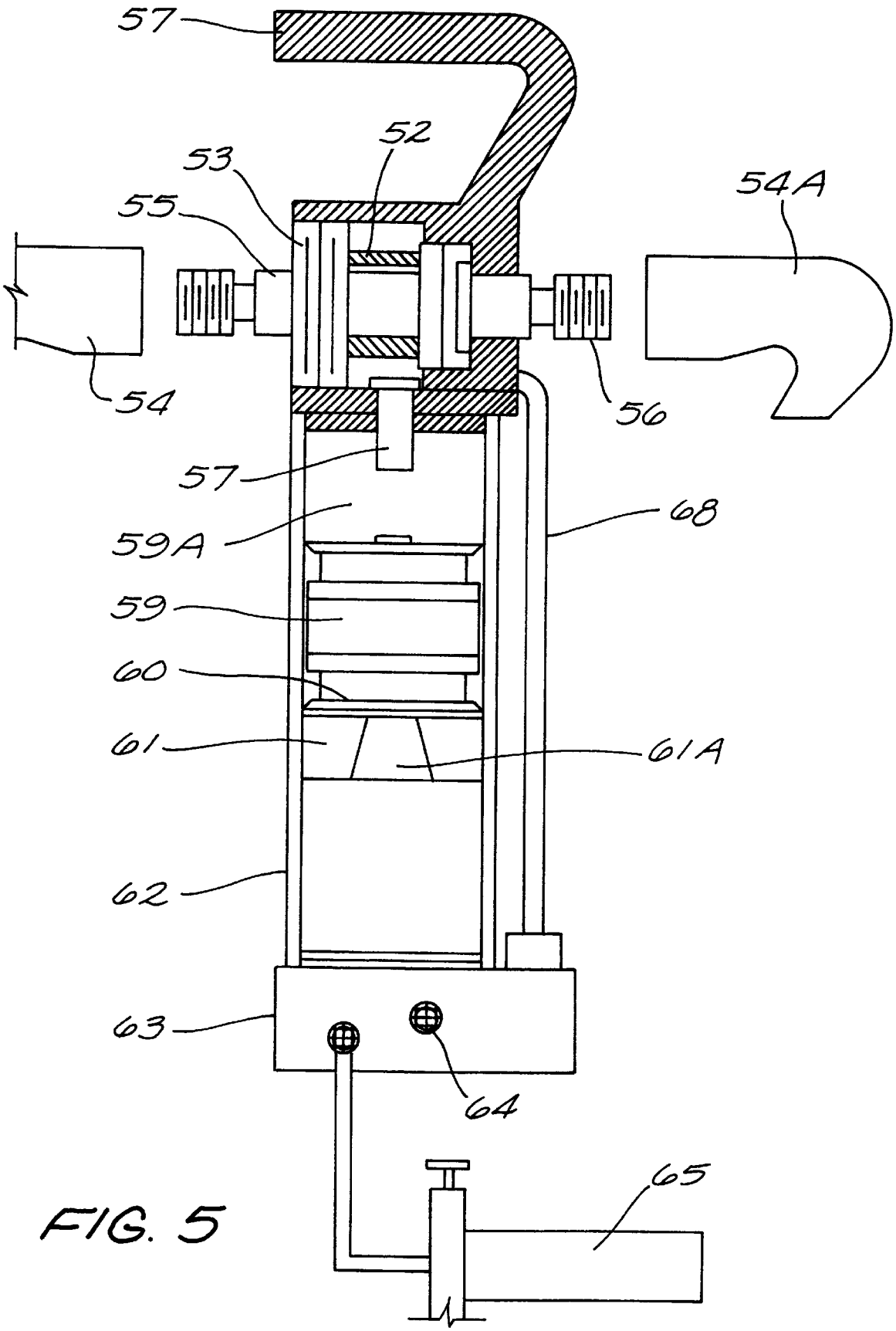
FIG. 5 is an operational view of an embodiment of the invention in which the pneumatic ram acts perpendicular to the motion of the hooks.

FIG. 5 is an operational view of an embodiment of the invention in which the pneumatic ram acts perpendicular to the motion of the hooks.

The technician attaches a hook 54 (the stationary end) to the damaged section and attaches the other hook 54 to the pulling end, pulling pressure is then applied to pull the damage out.

This tensile pulling pressure forces 57 hammer pin downward towards the piston 59, this is achieved by the female taper ring 52 and the pull rod male taper head 55 is now ready to be struck by piston 59.

The technician connects the air line to air inlet 64, a four-way valve is in housing 63. The air travels via 68 (supply tube) into the piston chamber 59A and forces the piston 59 against the air chamber seal 60.

When the operator actuates the remote control 65, the control valve 63 then vents the piston chamber to atmosphere and applies air pressure to the air reservoir 62.

The seal housing 61 has an orifice 61A with a seal approximately 1/12 the area of piston 59.

When the pressure increases on the air reservoir 62 side and reduces on the piston chamber 59A side, to the point where it can overcome the 12/1 advantage due to differential in pressure areas, piston 59 is forced off it's seat, 60 at which time, the complete surface area of piston 59 is exposed to the air reservoir 62 pressure causing piston 59 to accelerate with extreme force, striking hammer pin 57, driving it against female taper ring 52 which forces pull rod's 55 tapered head to move perpendicularly away from the center of the axis of the cylinder.

This action effectively shortens the distance (approximately 1/8 inch) between the pull hook 54A and stationary hook 54.

With sharp, strong shock, the operator continues to actuate remote control 65 and the cycle repeats.

Note that the movement of piston 59 is perpendicular to the relative motion of hooks 54 and 54A. Because of this, the apparatus of this figure is able to be used in tighter spaces.

This invention readily replaces the current methods available to relieve stress in the process of body and frame repair.

The sledge hammer action of the present invention is on the center line of the chain, allowing maximum stress relief at the heart of the structure, (including inside and outside of box-sections) thereby eliminating the need to over stretch the metal to overcome spring-back.

For all of these embodiments, the apparatus of this invention provides for a much safer operation for the operator and the vehicle.

With the present invention, more pulling is achieved with less pressure.

It is clear that the present invention creates a highly improved tool adapted for use in a variety of applications including automobile repair.

What is claimed is:

1. A tool for automobile repair comprising:

a) a pneumatic ram adapted to receive pneumatic pressure and having a first end and a second end, said pneumatic ram adapted to create relative motion between the first end and the second end thereof;

b) a first hook connected to the first end of said pneumatic ram;

c) a second hook connected to the second end of said pneumatic ram; and, d) cycling means having, 1) a hammer, a first end of said hammer adapted to receive shock force from said pneumatic ram, and, 2) contraction means, responsive to pressure from a second end of said hammer, for drawing said first hook towards said second hook, said cycling means for repetitively causing pneumatic pressure to be applied as impact force to said pneumatic ram, and, exhausting pneumatic pressure from said pneumatic ram.

2. The tool according to claim 1, a) further including operator adjustable gauge means for monitoring a contractional force being applied by said pneumatic ram, and for generating a pneumatic pulse when said contractional force is below an operator established threshold; and, b) wherein said cycling means is responsive to said pneumatic pulse.

3. The tool according to claim 1, wherein said pneumatic ram is adapted, when said pneumatic pressure is applied, to shorten a relative distance between said first hook and said second hook.

4. The tool according to claim 3, wherein said sensor means includes means for rapidly applying pneumatic pressure to said pneumatic ram.

5. The tool according to claim 4, wherein said pneumatic ram includes spring means for forcing said pneumatic ram into a relaxed state when said pneumatic pressure is exhausted from said pneumatic ram.

6. The tool according to claim 4, further including an operator control switch adapted to selectively apply air pressure to said pneumatic valve.

7. The tool according to claim 1, wherein motion of said pneumatic ram is perpendicular to a line formed through said first hook and said second hook.

8. The tool according to claim 1, a) wherein said pneumatic ram includes a moveable piston adapted to impact said hammer; and, b) further including means for applying a pulse of pneumatic pressure against said moveable piston, thereby causing said moveable piston to impact said hammer.

9. The tool according to claim 8, wherein said means for applying a pulse of pneumatic pressure includes:

a) a first chamber having a first diameter and housing said moveable piston;

b) a second chamber receiving pneumatic pressure thereinto; and, c) a seal interposed between said first chamber and said second chamber, said seal containing a channel adapted to communicate pneumatic pressure from said second chamber to said first chamber, said channel having a diameter significantly smaller than said first diameter.

10. The tool according to claim 9, further including means for forcing said moveable piston into contact with said seal when pressure within said second chamber is below a selected level.

11. A body repair tool for automobile repair comprising:

a) a contraction mechanism adapted to selectively apply a contracting shock force between a first hook and a second hook, said contraction mechanism having, 1) a pneumatic ram, 2) a hammer, a first end of said hammer adapted to receive force from said pneumatic ram, and, 3) a contracting mechanism responsive to said hammer and adapted to encourage said first hook to move towards said second hook; and, b) means for pulsing said contraction mechanism such that a predefined contracting force is repetitively applied between said first hook and said second hook.

12. The body repair tool according to claim 11, wherein said means for pulsing includes, 1) operator adjustable gauge means for monitoring the contractional force being applied and generating an indicia thereof, and, 2) cycling means, responsive to said indicia, for repetitively, A) causing pneumatic pressure to be applied to said pneumatic ram, and, B) exhausting pneumatic pressure from said pneumatic ram.

13. The body repair tool according to claim 12, wherein said cycling means includes:

a) pneumatic valve means being responsive to air pressure, said pneumatic valve means adapted to selectively communicate pneumatic pressure to said pneumatic ram;

b) sensor means being responsive to pressure exerted by said first hook and said indicia for selectively, 1) causing said pneumatic valve means to communicate pneumatic pressure to said pneumatic ram, and, 2) exhausting pneumatic pressure from said pneumatic ram.

14. The body repair tool according to claim 12, wherein said pneumatic ram includes:

a) first chamber having a first diameter and housing a moveable piston, said hammer being positioned such that a first end of said hammer receives force from said moveable piston when said first chamber receives pneumatic pressure thereto;

b) second chamber receiving pneumatic pressure thereinto;

c) a seal interposed between said first chamber and said second chamber, said seal containing a channel communicating pneumatic pressure from said second chamber to said first chamber, said channel being significantly smaller than said first diameter; and, d) means for forcing said moveable piston into contact with said seal when pressure within said second chamber is below a selected level.

15. A contracting tool comprising:

a) a pneumatic ram adapted to receive pneumatic pressure and having a first end and a second end, said pneumatic ram adapted to create relative motion between the first end and the second end thereof, said pneumatic ram having 1) a moveable piston, 2) a hammer having a first end adapted to receive impact force from said moveable piston, and, 3) contraction means, responsive to pressure from a second end of said hammer, for drawing said first hook towards said second hook;

b) a first hook connected to the first end of said pneumatic ram;

c) a second hook connected to the second end of said pneumatic ram;

d) sensor means for generating an air pressure representative of a force applied to said first hook;

e) an operator adjustable gauge means, responsive to air pressure from said sensor means, for generating a pneumatic pulse when said force is below an operator established threshold; and, f) an pneumatic applicator having, 1) an pneumatic valve means for selectively communicating pneumatic pressure to said pneumatic ram in response to said pneumatic pulse, and, 2) means for exhausting pneumatic pressure from said pneumatic ram in the absence of said pneumatic pulse.

16. The contracting tool according to claim 15, wherein said pneumatic ram includes spring means for forcing said pneumatic ram into a relaxed state and exhausting pneumatic pressure from said pneumatic pressure from said pneumatic ram.

17. The contracting tool according to claim 15, further including an operator control switch adapted to selectively apply an pneumatic pulse to said pneumatic valve.

18. The contracting tool according to claim 17, wherein said pneumatic ram includes:

a) a first chamber having a first diameter and housing said moveable piston;

b) a second chamber receiving pneumatic pressure thereinto;

c) a seal interposed between said first chamber and said second chamber, said seal containing a channel communicating pneumatic pressure from said second chamber to said first chamber, said channel having a second diameter being significantly smaller than said first diameter; and, d) means for forcing said moveable piston into contact with said seal when pressure within said second chamber is below a selected level.

* * * * *